US010112420B2

(12) United States Patent
Millan-Lorman et al.

(10) Patent No.: US 10,112,420 B2
(45) Date of Patent: Oct. 30, 2018

(54) FRAME LENGTH ADJUSTMENT

(71) Applicant: Hewlett-Packard Development Company, L.P., Houston, TX (US)

(72) Inventors: Carlos Millan-Lorman, Corvallis, OR (US); Jason C. Hower, Corvallis, OR (US); Cesar Fernandez, San Diego, CA (US); Timothy Wagner, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/514,064

(22) PCT Filed: Sep. 26, 2014

(86) PCT No.: PCT/US2014/057638
§ 371 (c)(1),
(2) Date: Mar. 24, 2017

(87) PCT Pub. No.: WO2016/048342
PCT Pub. Date: Mar. 31, 2016

(65) Prior Publication Data

US 2017/0291435 A1 Oct. 12, 2017

(51) Int. Cl.
*B41J 13/00* (2006.01)
*B41J 11/46* (2006.01)
*B41J 15/04* (2006.01)

(52) U.S. Cl.
CPC ..... *B41J 13/0009* (2013.01); *B41J 11/46* (2013.01); *B41J 15/04* (2013.01)

(58) Field of Classification Search
CPC ..... B41J 11/46
See application file for complete search history.

(56) References Cited

U.S. PATENT DOCUMENTS

| | | | | |
|---|---|---|---|---|
| 3,123,195 | A * | 3/1964 | Hewitt et al. | B41J 11/46 101/93.45 |
| 4,585,332 | A | 4/1986 | Shenoy | |
| 5,339,150 | A * | 8/1994 | Hubble, III | B41J 2/45 347/116 |
| 5,430,665 | A * | 7/1995 | Jin | G01B 11/043 33/735 |
| 5,564,846 | A | 10/1996 | Katsumata | |
| 5,813,327 | A | 9/1998 | Freeman et al. | |
| 6,160,609 | A | 12/2000 | Inoue | |
| 2003/0037690 | A1 | 2/2003 | Dreher et al. | |

(Continued)

FOREIGN PATENT DOCUMENTS

| | | |
|---|---|---|
| CN | 1445819 | 10/2003 |
| CN | 1938209 | 3/2007 |

(Continued)

*Primary Examiner* — Shelby L Fidler
(74) *Attorney, Agent, or Firm* — HP Inc. Patent Department

(57) ABSTRACT

In an example implementation, a method of adjusting frame length in an inkjet web press includes measuring a time T1 between a first sensor sensing a first mark and a second sensor sensing a second mark, and measuring a time T2 between the second sensor sensing the second mark and the first sensor sensing a next first mark. The method includes adjusting a gap between printed frames when T1 does not equal T2.

13 Claims, 4 Drawing Sheets

(56) References Cited

U.S. PATENT DOCUMENTS

| | | | | |
|---|---|---|---|---|
| 2003/0168798 | A1 | 9/2003 | Tufekci et al. | |
| 2005/0276465 | A1 | 12/2005 | Chen | |
| 2006/0086275 | A1* | 4/2006 | Fermandez | B41J 11/46 101/485 |
| 2007/0222805 | A1 | 9/2007 | Moscato et al. | |
| 2008/0203335 | A1 | 8/2008 | Ehrhardt et al. | |
| 2009/0027449 | A1* | 1/2009 | Silva | B41J 2/155 347/47 |
| 2009/0265950 | A1 | 10/2009 | Mizes et al. | |
| 2010/0026738 | A1 | 2/2010 | Saikawa et al. | |
| 2010/0046014 | A1 | 2/2010 | Eun et al. | |
| 2010/0238255 | A1* | 9/2010 | Inaba | B41J 11/009 347/218 |

FOREIGN PATENT DOCUMENTS

| | | |
|---|---|---|
| EP | 1285756 | 2/2003 |
| EP | 1658985 | 5/2006 |
| WO | WO-03086665 | 10/2003 |
| WO | WO-2009014686 | 1/2009 |

* cited by examiner

FRAME LENGTH ADJUSTMENT

CROSS-REFERENCE TO RELATED APPLICATION

This application is a U.S. National Stage Application of and claims priority to International Patent Application No. PCT/US2014/057638, filed on Sep. 26, 2014, and entitled "FRAME LENGTH ADJUSTMENT," which is hereby incorporated by reference in its entirety.

BACKGROUND

An inkjet web press is a high-speed, digital, industrial inkjet printing solution that prints on a continuous media web at speeds of hundreds of feet per minute. A roll of media (e.g., paper) on an unwinding device supplies the press with a paper web which is conveyed through the press along a media path. Stationary inkjet printheads along the media path eject ink droplets onto the web to form images. The paper web is then conveyed through a drying area and out of the press through rollers to be rewound on a rewinding device.

Aqueous inks used in inkjet printing contain a significant amount of water that can saturate the paper. The moisture content of the paper and tension along the paper path within the press, among other factors, can cause the paper to expand, lengthening the paper web. However, when the paper is dried, it can shrink back down to a length below its initial state. Therefore, the length of paper coming out of the press is often different than the length of paper being fed into the press. Among other things, this media distortion can complicate post-print finishing operations performed on the printed material by certain finishing devices.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Figure 1:
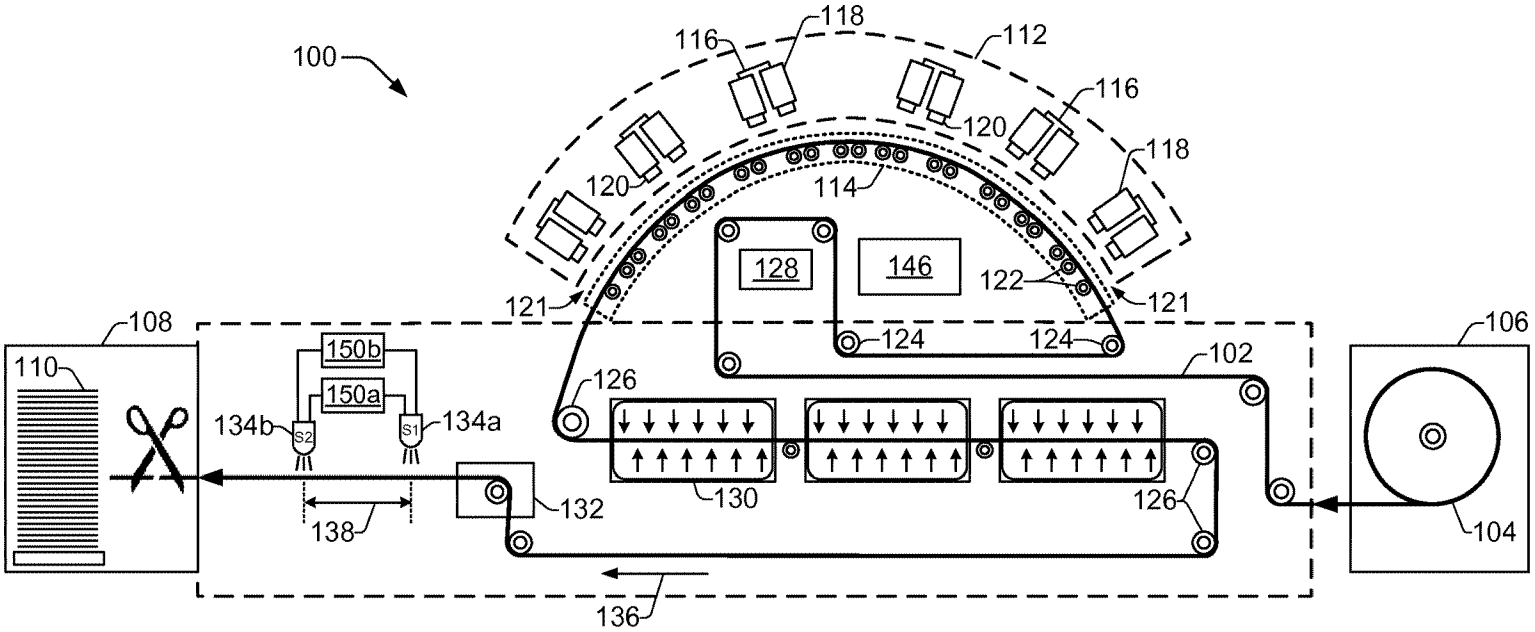
FIG. 1 shows a schematic illustration of an example printing system suitable to enable real-time frame length adjustments in an inkjet web press.

As noted above, the printing process in an inkjet web press can cause distortions in the length of the media web that complicate post-finishing operations in certain finishing devices. More specifically, the significant application of moisture to the web during printing, followed by the removal of that moisture through a drying process, typically results in a variability in print frame length and an overall reduction in the length of the web. For example, the media web can shrink at a rate of approximately 0.2%, which is about 1 foot for every 500 feet of web fed into the press.

Finishing devices that initiate finishing operations on a fixed index basis for each print frame printed on the web, or, multi-web finishing devices that combine rolls from different sources, do not tolerate such media distortions effectively. This is because the distorted media web eventually causes print frames to drift out of the finishing device's tolerance band, and the finishing operations (e.g., paper cuts) begin to occur within adjacent print frames rather than between print frames as intended. Fixed index finishing devices are, however, generally capable of staying within tolerances when used in conjunction with analog printing processes. This is because inks used in analog printing processes are formulated with much less water than the inks used in a digital inkjet web press. Therefore, analog printing involves less wetting and drying of the media, which results in less media distortion.

In order to accommodate the higher rate of media distortion associated with a digital inkjet web press, a finishing device would have to initiate finishing operations based on triggers from the media or the press. Advanced digital finishing devices are available that provide such triggering mechanisms based on control systems that compensate for the cumulative error in web length. However, many commercial (and other) print customers who operate digital inkjet web presses prefer the lower costs and higher productivity of fixed index finishing equipment. Moreover, many print customers who already own such legacy finishing equipment want to leverage it forward rather than incur the significant costs associated with acquiring more advanced digital finishing devices.

Prior methods of dealing with media distortions are based on dynamically measuring the length of the produced pages and then trying to adjust the frame length to make and keep it close to its nominal value. However, the mechanisms used to find the length of the page are based on measuring the speed of the paper at a point that is close to the end of the paper path, and measuring the time a page takes to pass through this point. The problem with this method is that the speed of the web is not constant. The speed varies during the time a page takes to pass through the point, so there is not a definite speed available to convert time into page length. Determining the precise speed of the paper is challenging. The speed can be derived from many marks laid on the paper and read by a sensor. However, due to considerations such as the real estate constraints of the printed page layout, it is not always possible to have a high enough number of marks on the page to provide an accurate average. The speed can also be measured indirectly, for example, by counting the revolutions of a roll of a known diameter. However, the accuracy of this measurement can suffer from errors due to paper slippage on the roll, or thermally induced variations of the diameter of the roll. The lack of accuracy in measuring the paper speed translates into a lack of accuracy in the measured frame length, which is often outside of acceptable ranges for some printing applications. For example, in packaging and other applications where the frames tend to be long, the errors experienced might not be acceptable.

Accordingly, example methods and systems described herein enable real-time frame length adjustments in an inkjet web press. A closed-loop mechanism continually monitors the length of the printed frames during the printing process and corrects deviations from the nominal length of the frames. The distance between two marks printed on the paper web is compared with the fixed distance between two stationary optical sensors that each sense one of the two marks. A gap between frames is increased or decreased in order to cause the sensors to see their respective marks simultaneously, which will result in the distance between the two marks being equal to the fixed distance between the two sensors.

In one example implementation, a method of adjusting print frame length in an inkjet web press includes measuring a time T1 between a first sensor sensing a first mark and a second sensor sensing a second mark, measuring a time T2 between the second sensor sensing the second mark and the first sensor sensing a next first mark, and adjusting a gap between printed frames when T1 does not equal T2.

In another example, an inkjet web press includes a plurality of printheads to print first and second marks into print frames on a media web as the web passes through a print zone. The first marks are separated from the second marks across the width of the web by a cross-web distance. The web press includes first and second sensors that are also separated across the web by the cross-web distance, such that the first sensor is aligned across the web with the first marks to sense the first marks as they pass by the first sensor, and the second sensor is aligned across the web with the second marks to sense the second marks as they pass by the second sensor.

In another example, a non-transitory machine-readable storage medium stores instructions that when executed by a processor of a web press, cause the web press to print images in frames on a media web, and print first and second marks into the frames. The instructions further cause the press to sense a first mark with a first sensor and a second mark with a second sensor. The sensors are separated from one another by a distance in a down-web direction. Based on the sensing of the marks, the press adjusts a gap between the frames if the first and second marks are not separated by the same distance as the first and second sensors.

FIG. 1 shows a schematic illustration of an example printing system 100 suitable to enable real-time frame length adjustments in an inkjet web press. The printing system 100 is shown in FIG. 1 and will be described herein, as an inkjet web press 100. However, there is no intent to limit the printing system 100 to the implementation shown and described with regard to FIG. 1. Rather, various concepts disclosed herein, including those regarding adjusting the length of printing frames in real-time, may be applicable to other configurations and types of printing systems 100 as appropriate.

An inkjet web press 100 is generally configured to print ink or other fluid onto a web of media 102 supplied by a media roll 104 from an unwinding device 106, also shown in FIG. 1. The web of media 102 (variously referred to herein as media web 102, web 102, media 102, etc.) comprises printing material such as cellulose-based material (i.e., paper) or polymeric material, for example. In the present implementation, the media web 102 is considered to be a cellulose-based paper material that exhibits expansion when moisture is applied and contraction when the moisture is removed. The width across the media web 102 can vary, but is on the order of 20-40 inches.

As the media web 102 exits the inkjet web press 100, it may be rewound on a rewinding device (not shown) and subsequently transferred to a near-line finishing device, or it may pass directly to a post-print, in-line finishing device 108, as shown in FIG. 1. Finishing devices 108 perform finishing operations on printed material after printing has been completed. Such operations include, for example, paper slitting, cutting, trimming, die-cutting, folding, coating, embossing, and binding. While finishing operations can be performed by one or more finishing devices that are in-line or near-line with the press 100, the present implementation is discussed with regard to a single in-line web cutting finishing device 108, as shown in FIG. 1. The finishing device 108 comprises a fixed index web cutting device, such as a cutoff knife on a rotary drum, that cuts the media web 102 at fixed intervals. Cut media from the web 102 is shown as a media stack 110, which may be collected within finishing device 108 or within a separate media stacking device (not shown).

Inkjet web press 100 includes a print module 112 and media support 114. Print module 112 includes a number of print bars 116, and one or more pens or cartridges 118 that each include a number of fluid drop jetting printheads 120. Printheads 120 eject drops of ink or other fluid through a plurality of orifices or nozzles (not shown) toward the media web 102 so as to print onto the web 102. Thus, a print zone 121 is established between the print module 112 and media support 114. Nozzles are typically arranged on printheads 120 in one or more columns or arrays so that properly sequenced ejection of ink causes characters, symbols, and/or other graphics or images to be printed on media web 102 as it moves relative to print bars 116 along media support 114.

Media support 114 comprises a number or media rollers 122 that support the media web 102 as it passes through the print zone 121 in close proximity to the print bars 116. Media support 114 receives the web 102 from media drive rollers 124 and delivers the printed upon web 102 to media rewind rollers 126. Drive rollers 124 are generally referred to herein as rollers that precede the media support 114 along the media web path, while rewind rollers 126 are referred to as rollers that follow the media support 114 along the media web path. The drive 124 and rewind 126 rollers are control rollers driven by a web drive 128.

As the media web 102 passes through the print zone 121 along media support 114, it becomes wet from ink and/or other fluid ejected from printheads 120. As noted above, the wetting of the web 102 causes the media to expand, which lengthens the web. The inkjet web press 100 includes one or more thermal dryers 130 that remove the moisture from the web 102 by forcing warm air across the web as it passes over a series of rollers. The drying process typically shrinks the media back down to a level below its initial length. Thus, the wetting and drying of the web 102 effectively result in a net reduction in the length of the media web 102.

In some examples, the media web 102 may be routed through a post-print function 132 after being dried by thermal dryers 130. A post-print function 132 can include, for example, a moisturizer component to spray water on the paper web 102 to return the paper back to an equilibrium moisture content following the drying by dryers 130, a silicon spray component to spray silicon on the paper web to help the paper slide over a folder or other component in a post-print finishing operation, and so on.

Figure 2:
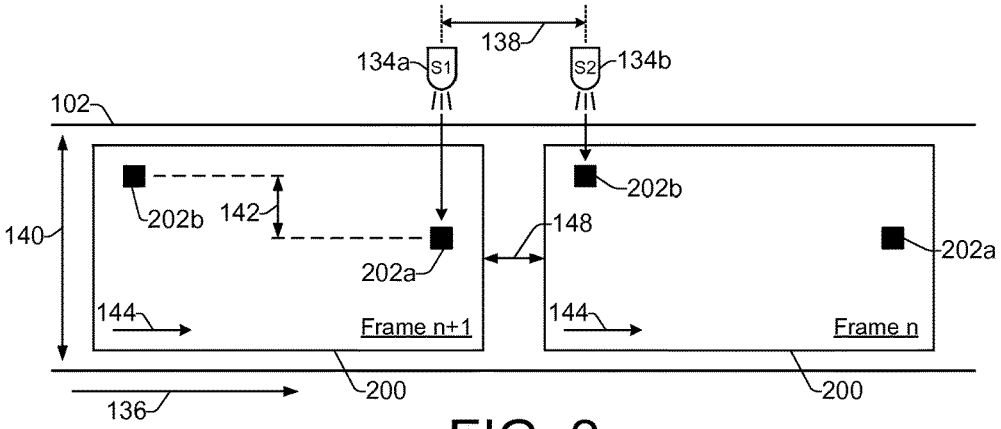
FIG. 2 shows an example of a portion of the media web with two frames of image content that have been printed on the web by printheads.

FIG. 2 shows an example of a portion of the media web 102 with two frames 200 of image content (i.e., frame n, frame n+1) that have been printed on the web 102 by printheads 120. Referring generally to both FIGS. 1 and 2, the web press 100 includes two optical sensors 134 (illustrated as first sensor S1, 134*a*, and second sensor S2, 134*b*) located at the end of the print media path of the press 100. The optical sensors 134 may comprise any appropriate imaging device such as a scanner, a camera, or other imager, implementing various image sensors such as CCD's (charge coupled devices), CMOS devices, and so on. A light source (not shown) may accompany the optical sensors 134 to provide illumination for reflecting off the web 102.

The sensors 134 are separated from one another in a down-web direction 136 by a fixed down-web distance 138. The down-web distance 138 is a distance that is less than the minimum length of a printed frame 200, as shown in FIG. 2. In some examples, the down-web distance 138 is approximately 7 inches. The sensors 134 are also separated slightly from one another in a cross-web direction 140 by a cross-web distance 142. In some examples, the cross-web distance 142 is approximately 0.5 inches. The cross-web distance 142 is the same distance by which two sensor marks 202 (illustrated as first mark 202*a* and second mark 202*b*) are separated across the web 102. The two sensor marks, 202*a* and 202*b*, are printed in each frame 200, and the sensors 134 are positioned in the cross-web direction 140 so that sensor S1, 134*a*, is aligned with sensor marks 202*a* and sensor S2, 134*b*, is aligned with sensor marks 202*b*. Sensor S1, 134*a*, comes first in the media movement direction 144, and sensor S2, 134*b*, comes second in the media movement direction 144. The marks, 202*a* and 202*b*, are printed with the intent that they be apart from one another in the down-web direction 136 by the same distance that the sensors 134 are apart. Thus, in the absence of any error, each sensor mark 202 will be simultaneously seen by its corresponding sensor 134. That is, if there is no distortion in the length of the web 102 (e.g., due to water content, heating, print path tension, etc.), sensor 134*a* will see mark 202*a* at precisely the same time that sensor 134*b* sees mark 202*b*. However, as noted above, the paper web 102 often experiences expansion and/or contraction (shrinkage) during the printing process, so the sensor marks 202 are often not the same distance apart from one another as the sensors are, and the sensors 134 will not see their corresponding marks 202 at the same time. The differences in these distances are an indication that the length of the print frames 200 are distorted, which can result in unacceptable printed product from finishing devices, such as a cutting device. In order to compensate for these frame length distortions, methods and systems described herein enable real-time frame length adjustments in an inkjet web press.

Figure 3:
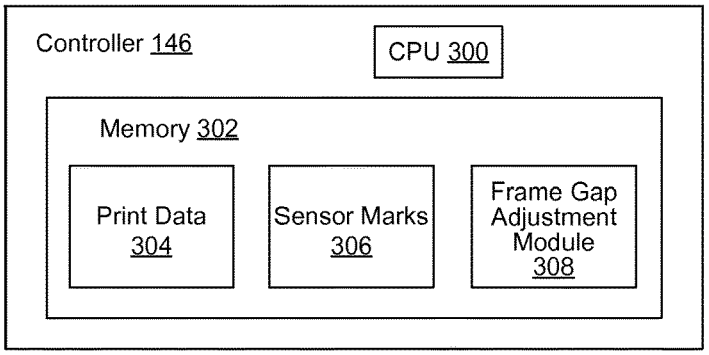
FIG. 3 shows a box diagram of an example controller suitable for controlling print functions of an inkjet web press and for compensating for frame length distortions by dynamically adjusting the size of a gap between frames on the media web.

FIG. 3 shows a box diagram of an example controller 146 suitable for controlling print functions of an inkjet web press 100 and for compensating for frame length distortions by dynamically adjusting the size of a gap between frames 200 on the media web 102. Controller 146 generally comprises a processor (CPU) 300 and a memory 302, and may additionally include firmware and other electronics for communicating with and controlling the other components of the press 100, as well as external devices such as unwinding device 106. Memory 302 can include both volatile (i.e., RAM) and nonvolatile (e.g., ROM, hard disk, optical disc, CD-ROM, magnetic tape, flash memory, etc.) memory components. The components of memory 302 comprise non-transitory, machine-readable (e.g., computer/processor-readable) media that provide for the storage of machine-readable coded program instructions, data structures, program instruction modules, JDF (job definition format), and other data for the printing press 100, such as modules 304, 306 and 308. The program instructions, data structures, and modules stored in memory 302 may be part of an installation package that can be executed by processor 300 to implement various examples, such as examples discussed herein. Thus, memory 302 may be a portable medium such as a CD, DVD, or flash drive, or a memory maintained by a server from which the installation package can be downloaded and installed. In another example, the program instructions, data structures, and modules stored in memory 302 may be part of an application or applications already installed, in which case memory 302 may include integrated memory such as a hard drive.

Controller 146 may receive data 304 from a host system, such as a computer, and temporarily store the data 304 in memory 302. Data 304 represents, for example, a document and/or file to be printed. As such, data 304 forms a print job for inkjet web press 100 that includes one or more print job commands/instructions, and/or command parameters executable by processor 300. Thus, controller 146 controls inkjet printheads 120 to eject ink drops from printhead nozzles onto media web 102 as the web 102 passes through the print zone 121. The controller 146 thereby defines a pattern of ejected ink drops that form characters, symbols, and/or other graphics or images on the media web 102. The pattern of ejected ink drops is determined by the print job commands and/or command parameters within data 304. In addition to print data 304, controller 146 can print sensor marks 306 that represent first and second sensor marks 202*a* and 202*b*.

Referring now to FIGS. 1-3, in one example, controller 146 includes a frame gap adjustment module 308 stored in memory 302. The frame gap adjustment module 308 comprises instructions executable on processor 300 to precisely control when the print module 212 begins printing each print frame 200 of a print job on the media web 102. In some instances, module 308 may delay the printing of a print frame 200 for an amount of time in order to increase the gap 148 between frames 200. In other instances, module 308 may advance the printing of a print frame 200 by a certain amount of time in order to decrease the gap 148 between frames 200.

Figure 4:
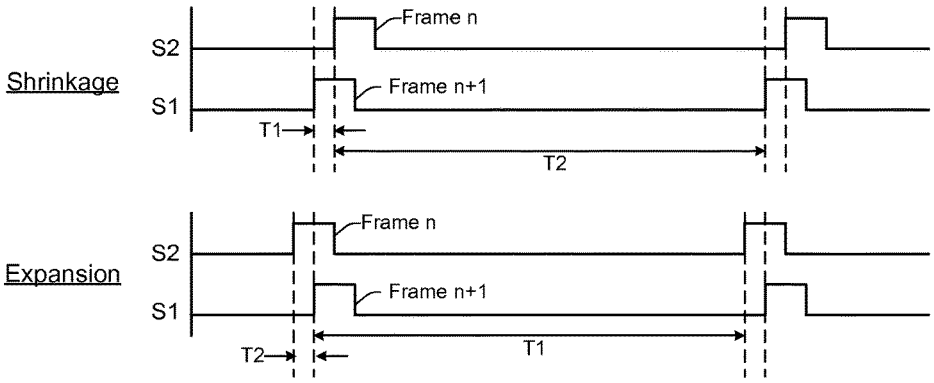
FIG. 4 shows examples of two timing diagrams that demonstrate the timing of sensors while sensing marks in real-time in a scenario when the frame length has contracted and in a scenario when the frame length as expanded.

A print frame 200 comprises a unit of formatted output (i.e., print job instructions) and two sensor marks 202 printed onto the web 102. In general, the module 308 determines when to trigger the printing of each print frame 200 based on timing signals received from a first timer 150*a* and a second timer 150*b* coupled to sensors 134. As mentioned above, sensors 134 sense marks 202 that have been printed on the passing web 102. Referring additionally now to FIG. 4, two scenarios will be discussed in which the sensors 134, timers 150, and module 308 function to adjust the size of gap 148 to compensate for distortions in the length of the web 102 (and frames 200). FIG. 4 shows examples of two timing diagrams that demonstrate the timing of sensors 134 while sensing marks 202 in real-time in a scenario when the frame length has contracted (i.e., shrank) and in a scenario when the frame length as expanded.

Referring to FIGS. 1-4, during a printing process in web press 100, sensor marks 202*a* and 202*b* are printed onto the media web 102. In a first scenario where the web 102 has undergone shrinkage, the sensor S1 (134*a*) sees (i.e., senses) mark 202*a* in frame n+1 as the web 102 travels along the print path in the direction 144. Shortly thereafter, sensor S2 (134*b*) sees mark 202*b* in frame n. The first timer 150*a* measures the time between these sensing events as time T1. That is, the first timer 150*a* starts counting when sensor S1 (134*a*) senses mark 202*a* in frame n+1, and it stops counting when sensor S2 (134*b*) senses mark 202*b* in frame n. Likewise, the second timer 150*b* measures the time between sensor S2 (134*b*) sensing mark 202*b* in frame n, and sensor S1 (134*a*) sensing a next mark 202*a*. The second timer 150*b* measures the time between these sensing events as time T2.

The controller 146, executing frame gap adjustment module 308 on a processor 300, receives and analyzes times T1 and T2 to determine if there is a difference between times T1 and T2. A difference between times T1 and T2 indicates that the distance between marks 202*a* and 202*b* is not the same as the fixed distance between sensor S1 (134*a*) and sensor S2 (134*b*), which in turn indicates that there is some error, or distortion, in the length of the frames. More specifically, when T1 is less than T2, as shown in the first scenario shown in FIG. 4, the controller 146 determines that the frame length has undergone shrinkage, and that the gap should be therefore be increased in size to compensate for the shrinkage. The error, or amount of time by which the gap is adjusted is the lesser of the two times T1 and T2. The analysis performed by execution of the frame gap adjustment module 308 to determine the correction error is demonstrated by the following equation:

$$\text{error}=\text{sign}(T1-T2)*\min(T1,T2)$$

where: sign(x) is 1 if x>0, −1 if x<0, and zero if x=0, and min(x, y) is the minimum of x and y.

In a second scenario where the web 102 has undergone expansion, sensor S2 (134*b*) senses mark 202*b* in frame n as the web 102 travels along the print path in the direction 144. Shortly thereafter, sensor S1 (134*a*) sees mark 202*a* in frame n+1. The second timer 150*b* measures the time between these sensing events as time T2. That is, the second timer 150*b* starts counting when sensor S2 (134*b*) senses mark 202*b* in frame n, and it stops counting when sensor S1 (134*a*) senses mark 202*a* in frame n+1. Likewise, the first timer 150*a* measures the time between sensor S1 (134*a*) sensing mark 202*a* in frame n+1, and sensor S2 (134*b*) sensing mark 202*b* in frame n+1. The first timer 150*a* measures the time between these sensing events as time T1.

The controller 146 receives and analyzes times T1 and T2 for a difference. Again, a difference between times T1 and T2 indicates that the distance between marks 202*a* and 202*b* is not the same as the fixed distance between sensor S1 (134*a*) and sensor S2 (134*b*), which in turn indicates that there is some error, or distortion, in the length of the frames. More specifically, when T1 is greater than T2, as shown in the second scenario shown in FIG. 4, the controller 146 determines that the frame length has undergone expansion, and that the gap should be therefore be decreased in size to compensate for the expansion. The error, or amount of time by which the gap is adjusted is the lesser of the two times T1 and T2. As in the above example, the analysis performed by execution of the frame gap adjustment module 308 to determine the correction error is demonstrated by the following equation:

$$\text{error}=\text{sign}(T1-T2)*\min(T1,T2)$$

where: sign(x) is 1 if x>0, −1 if x<0, and zero if x=0, and min(x, y) is the minimum of x and y.

Figure 5:
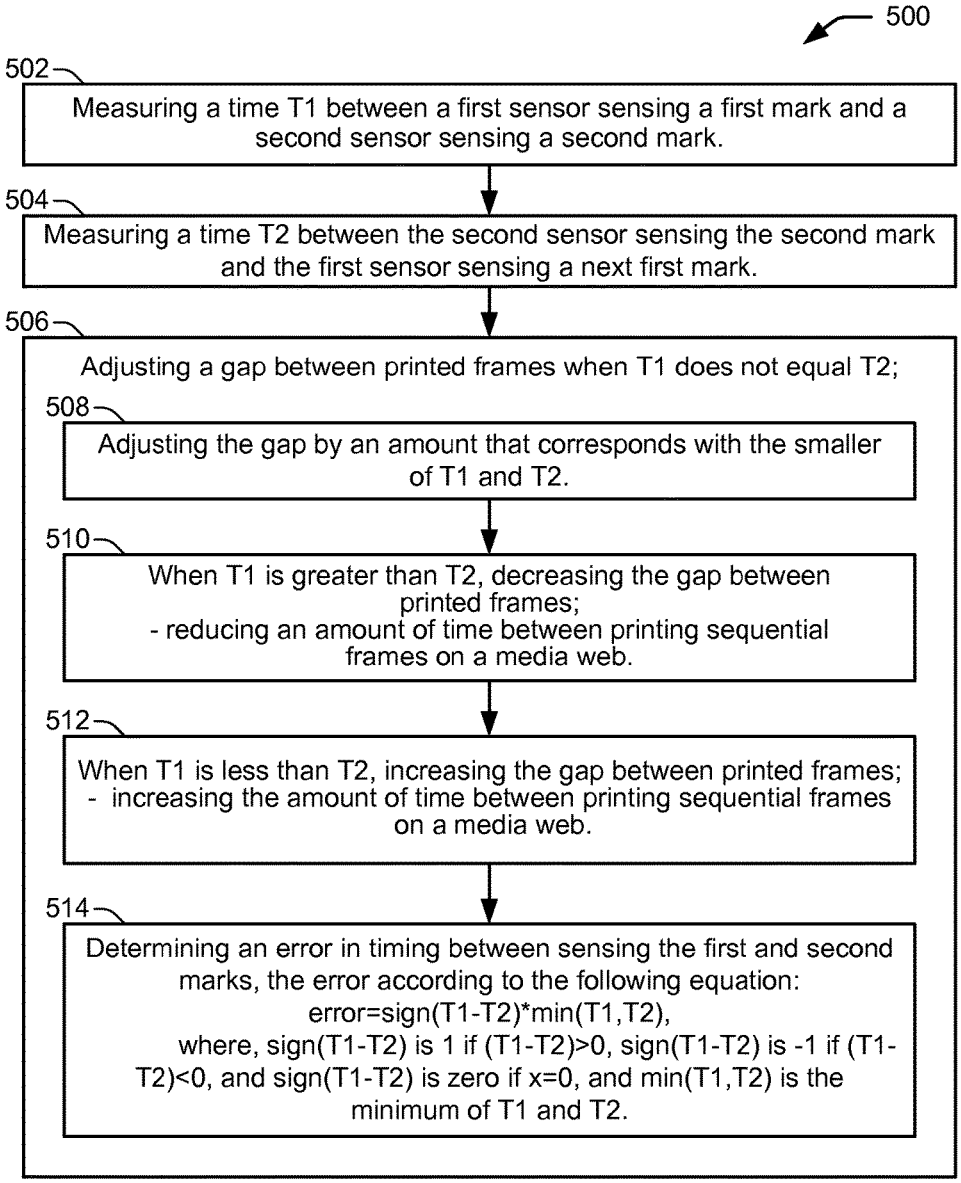
FIGS. 5 and 6 show flow diagrams that illustrate example methods 500 and 600, related to compensating for frame length distortions by dynamically adjusting the size of a gap between frames on the media web.
Figure 6:
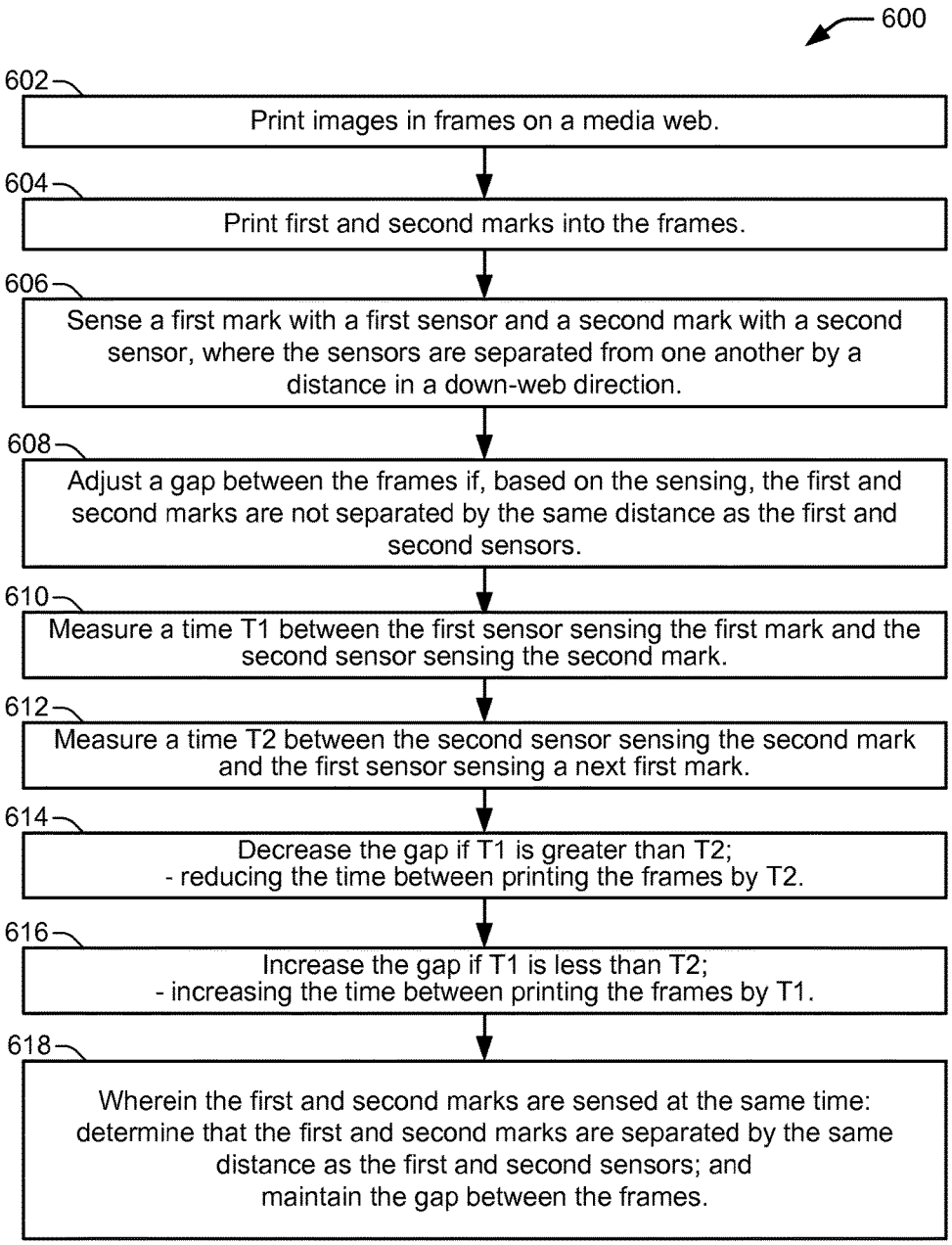

FIGS. 5 and 6 show flow diagrams that illustrate example methods 500 and 600, related to compensating for frame length distortions by dynamically adjusting the size of a gap between frames on the media web. Methods 500 and 600 are associated with the examples discussed above with regard to FIGS. 1-4, and details of the operations shown in methods 500 and 600 can be found in the related discussion of such examples. The operations of methods 500 and 600 may be embodied as programming instructions stored on a non-transitory, machine-readable (e.g., computer/processor-readable) medium, such as memory 302 as shown in FIG. 3. In some examples, implementing the operations of methods 500 and 600 can be achieved by a processor, such as a processor 300 of FIG. 3, reading and executing the programming instructions stored in a memory 302. In some examples, implementing the operations of methods 500 and 600 can be achieved using an ASIC (application specific integrated circuit) and/or other hardware components alone or in combination with programming instructions executable by processor 300.

Methods 500 and 600 may include more than one implementation, and different implementations of methods 500 and 600 may not employ every operation presented in the respective flow diagrams. Therefore, while the operations of methods 500 and 600 are presented in a particular order within the flow diagrams, the order of their presentation is not intended to be a limitation as to the order in which the operations may actually be implemented, or as to whether all of the operations may be implemented. For example, one implementation of method 500 might be achieved through the performance of a number of initial operations, without performing one or more subsequent operations, while another implementation of method 500 might be achieved through the performance of all of the operations.

Referring now to the flow diagram of FIG. 5, an example method 500 of adjusting frame length in an inkjet web press begins at block 502, with measuring a time T1 between a first sensor sensing a first mark and a second sensor sensing a second mark. The method includes measuring a time T2 between the second sensor sensing the second mark and the first sensor sensing a next first mark, as shown at block 504. As shown at block 506, the method includes adjusting a gap between printed frames when T1 does not equal T2. In some examples, adjusting the gap comprises adjusting the gap by an amount that corresponds with the smaller of T1 and T2, as shown at block 508. In some examples, when T1 is greater than T2, adjusting the gap comprises decreasing the gap between printed frames, as shown at block 510. Decreasing the gap between printed frames can include reducing an amount of time between printing sequential frames on a media web. As shown at block 512, in some examples, when T1 is less than T2, adjusting the gap comprises increasing the gap between printed frames. Increasing the gap between printed frames can include increasing the amount of time between printing sequential frames on a media web. As shown at block 514, in some examples, adjusting the gap comprises determining an error in timing between sensing the first and second marks, where the error is according to the following equation:

$$\text{error}=\text{sign}(T1-T2)*\min(T1,T2),$$

where, sign(T1−T2) is 1 if (T1−T2)>0, sign(T1−T2) is −1 if (T1−T2)<0, and sign(T1−T2) is zero if x=0, and min(T1, T2) is the minimum of T1 and T2.

Referring now to the flow diagram of FIG. 6, an example method 600 related to adjusting frame length in an inkjet web press begins at blocks 602 and 604 with printing images in frames on a media web and printing first and second marks into the frames. As shown at block 606, a first mark is sensed with a first sensor and a second mark is sensed with a second sensor. The sensors are separated from one another by a distance in a down-web direction. The method continues at block 608 with adjusting a gap between the frames if, based on the sensing, the first and second marks are not separated by the same distance as the first and second sensors. As shown at blocks 610 and 612, respectively, a time T1 is measured between the first sensor sensing the first mark and the second sensor sensing the second mark, and a time T2 is measured between the second sensor sensing the second mark and the first sensor sensing a next first mark. As shown at block 614, the gap is decreased if T1 is greater than T2. Decreasing the gap can include reducing the time between printing the frames by the amount T2. As shown at block 616, the gap is increased if T1 is less than T2. Increasing the gap can include increasing the time between printing the frames by T1. As shown at block 618, when the first and second marks are sensed at the same time, it is determined that the first and second marks are separated by the same distance as the first and second sensors, and the gap between the frames is therefore maintained at the same size.

What is claimed is:

1. A frame length adjusting inkjet web press comprising:

a plurality of printheads to print first and second marks into print frames on a media web as the web passes through a print zone, the first marks separated from the second marks across the web by a cross-web distance;

first and second sensors separated across the web by the cross-web distance, the first sensor aligned across the web with the first marks to sense the first marks as they pass by the first sensor, and the second sensor aligned across the web with the second marks to sense the second marks as they pass by the second sensor;

a first timer to measure a time T1 from the first sensor sensing a first mark and the second sensor sensing a second mark;

a second timer to measure a time T2 from the second sensor sensing the second mark and the first sensor sensing a next first mark; and a controller to control a gap between the frames by regulating when the frames are printed on the web based on T1 and T2.

2. An inkjet web press as in claim 1, wherein the first and second sensors are separated by a down-web distance that is less than a minimum frame length.

3. An inkjet web press as in claim 1, wherein the cross-web distance is less than a minimum frame width.

4. A method of adjusting frame length in an inkjet web press comprising:

measuring a time T1 between a first sensor sensing a first mark and a second sensor sensing a second mark;

measuring a time T2 between the second sensor sensing the second mark and the first sensor sensing a next first mark; and adjusting a gap between printed frames when T1 does not equal T2.

5. A method as in claim 4, wherein adjusting a gap between printed frames comprises:

adjusting the gap by an amount that corresponds with the smaller of T1 and T2.

6. A method as in claim 4, wherein adjusting a gap between printed frames comprises:

when T1 is greater than T2, decreasing the gap between printed frames; and when T1 is less than T2, increasing the gap between printed frames.

7. A method as in claim 6, wherein:

decreasing the gap between printed frames comprises reducing an amount of time between printing sequential frames on a media web; and increasing the gap between printed frames comprises increasing the amount of time between printing sequential frames on a media web.

8. A method as in claim 4, wherein adjusting a gap between printed frames comprises determining an error in timing between sensing the first and second marks, the error according to the following equation:

$$\text{error}=\text{sign}(T1-T2)*\min(T1,T2),$$

where, sign(T1−T2) is 1 if (T1−T2)>0, sign(T1−T2) is −1 if (T1−T2)<0, and sign(T1−T2) is zero if (T1−T2) [x]=0, and min(T1,T2) is the minimum of T1 and T2.

9. A non-transitory machine-readable storage medium storing instructions that when executed by a processor of a web press, cause the web press to:

print images in frames on a media web;

print first and second marks into the frames;

sense a first mark with a first sensor and a second mark with a second sensor, where the sensors are separated from one another by a distance in a down-web direction;

adjust a gap between the frames if, based on the sensing, the first and second marks are not separated by the same distance as the first and second sensors.

10. A medium as in claim 9, the instructions further causing the web press to:

measure a time T1 between the first sensor sensing the first mark and the second sensor sensing the second mark;

measure a time T2 between the second sensor sensing the second mark and the first sensor sensing a next first mark;

decrease the gap if T1 is greater than T2; and increase the gap if T1 is less than T2.

11. A medium as in claim 10, wherein decreasing the gap comprises reducing the time between printing the frames by T2.

12. A medium as in claim 10, wherein increasing the gap comprises increasing the time between printing the frames by T1.

13. A medium as in claim 9, wherein the first and second marks are sensed at the same time, the instructions further causing the web press to:

determine that the first and second marks are separated by the same distance as the first and second sensors; and maintain the gap between the frames.

* * * * *